United States Patent [19]

Hinotami et al.

[11] Patent Number: 4,754,190

[45] Date of Patent: Jun. 28, 1988

[54] FLAT CATHODE-RAY TUBE AND DEFLECTION YOKE

[75] Inventors: Katsuhiro Hinotami, Shijonawate; Shunichi Kishimoto, Kaizuka; Goro Hamagishi, Toyonaka; Masahiko Miyazaki, Osaka; Shinji Yoshiyama, Daito, all of Japan

[73] Assignee: Sanyo Electric Co., Ltd., Moriguchi, Japan

[21] Appl. No.: 27,389

[22] Filed: Mar. 18, 1987

[30] Foreign Application Priority Data

| | | | |
|---|---|---|---|
| Mar. 19, 1986 | [JP] | Japan | 61-62451 |
| May 26, 1986 | [JP] | Japan | 61-120863 |
| May 26, 1986 | [JP] | Japan | 61-120864 |

[51] Int. Cl.[4] ..... H01J 29/76; H01J 29/86

[52] U.S. Cl. ..... 313/422; 313/440; 313/477 R; 335/213

[58] Field of Search ..... 313/440, 422, 477 R; 358/248; 335/213 (U.S. only)

[56] References Cited

U.S. PATENT DOCUMENTS

| | | | |
|---|---|---|---|
| 2,240,606 | 5/1941 | Bobb | 313/440 X |
| 2,842,711 | 7/1958 | Frenkel . | |
| 3,192,432 | 6/1965 | Nero | 313/440 X |

FOREIGN PATENT DOCUMENTS

| | | |
|---|---|---|
| 0139760 | 5/1985 | European Pat. Off. . |
| 57-176653 | 10/1982 | Japan . |
| 59-87741 | 5/1984 | Japan . |
| 59-167942 | 9/1984 | Japan . |
| 2133211 | 7/1984 | United Kingdom . |

*Primary Examiner*—Palmer C. DeMeo

*Attorney, Agent, or Firm*—Armstrong, Nikaido, Marmelstein & Kubovcik

[57] ABSTRACT

A flat cathode-ray tube has a tubular glass body comprising a tubular neck portion, a flat funnel portion, a flat box-shaped head portion, an electron gun housed in the neck portion, and a fluorescent screen at the head portion. At least the funnel portion is made entirely of a flat glass plate. A deflection yoke, mounted on the junction of the neck and funnel portions, comprises a core having at its funnel-side end an opening approximately rectangular with substantially straight upper and lower sides and gently outwardly bulging arcuate opposite lateral sides. The core's inner surface, defining an opening, is continuously reducing in size from the funnel side toward the neck portion conforming with the tapered shape of the funnel portion. The yoke further comprises a pair of vertical deflection coils wound around an upper and a lower portion of the core. A pair of horizontal deflection coils, each have horizontal portions extending at least along the opposite sides of the funnel portion. A front-end bridge portion extends from the horizontal portion approximately perpendicular thereto and is positioned on the upper or bottom surface of the funnel portion in a direction perpendicular to the electron beam.

5 Claims, 5 Drawing Sheets

FLAT CATHODE-RAY TUBE AND DEFLECTION YOKE

FIELD OF INDUSTRIAL APPLICATION

The present invention relates to a flat cathode-ray tube for use in thin television receivers, and more particularly to improvements in the deflection yoke of a flat cathode-ray tube wherein at least a funnel portion comprises a glass tube which is entirely made of a flat glass plate.

PRIOR ART

Compact thin television receivers are known in which a fluorescent screen is disposed at an angle of inclination with the direction of an electron beam from a neck tube incorporating an electron gun to reproduce images on the screen by stimulating the screen with the electron beam for luminescence and to view the images through a transparent panel opposed to the screen or through a panel bearing the screen. The cathode-ray tube heretofore used in the television receiver of this type is in the form of a flat glass tube as shown in FIGS. 13 and 14. The glass tube has a panel 20 which is prepared from glass by press molding for providing a fluorescent screen 38 and which is round at its edge and corner portions. Accordingly, the glass tube has the problem that the round portions correspondingly decrease the area of the fluorescent screen since the screen can not be formed on the round portions which distort the image to be formed thereon. The glass tube has another problem in that it necessitates much labor and a high cost to make since the glass molding operation requires not only an expensive mold but also the cumbersome steps of melting glass, pouring the molten glass into the mold and grinding the product after solidification.

Accordingly, the present applicant has already proposed in pending U.S. patent application Ser. No. 927,975 a glass tube as shown in FIGS. 11 and 12 for use as a flat cathode-ray tube. Both the foregoing problems can be overcome by the proposal because the funnel portion and the head portion of the glass tube are made entirely of a flat glass plate to eliminate the press molding process for the fluorescent screen panel.

Thus, the funnel and head portions of the glass tube are entirely made of a flat glass plate, but the cathode-ray tube comprising this glass tube still has the following problem.

With reference to FIG. 15, a neck tube 10 generally in the form of a hollow cylinder is joined to the funnel portion 12, with one end of the tube 10 slightly projecting toward the head portion 14 into the funnel portion 12. To deflect an electron beam B horizontally and vertically for scanning, a deflection yoke is mounted on the junction between the neck tube 10 and the base end of the funnel portion 12 or in the vicinity of the junction. We have found that unless the center of deflection, 0, of the electron beam is positioned inwardly of the funnel portion 12 at least a small distance forwardly away from the opening of the neck tube 10, the electron beam B strikes the inner surface of the neck tube to produce a neck shadow. On the other hand, in the case of the conventional glass tube shown in FIG. 16, occurrence of such neck shadow is avoidable when the center of deflection, 0, is positioned in the vicinity of the junction of the neck tube and the funnel portion. The core of the deflection yoke heretofore used has a circular inner surface, so that forward shift of the deflection of yoke to properly position the center of deflection of the electron beam gives rise to the necessity of diametrically enlarging the core in corresponding relation to the lateral widthwise dimension of the funnel portion. Nevertheless, this is in conflict with attempts to make the television receiver as thin as possible, further creating a clearance between the tube funnel portion and a vertical deflection coil wound around the core to result in the drawback of an impaired vertical deflection sensitivity.

SUMMARY OF THE INVENTION

An object of the present invention, which has been accomplished in view of the foregoing problems, is to provide a flat cathode-ray tube wherein at least a glass tube funnel portion is made entirely of a flat glass plate and which has a neck tube joined to the funnel portion with its one end slightly projecting into the funnel portion toward the head portion of the cathode-ray tube. The cathode-ray tube has satisfactory horizontal and vertical electron beam deflection sensitivities without any likelihood of casting a shadow on its fluorescent screen.

Another object of the present invention is to provide a flat deflection yoke mounted on the junction of the neck portion and the funnel portion of the cathode-ray tube. The yoke comprises a core, having at one end, positioned around the funnel portion, an opening approximately rectangular or in the form of a rectangle. The opening has substantially straight upper and lower sides and gently outwardly bulging arcuate opposite lateral sides. The core has an inner surface defining the opening. The core extends at least from the open end to the junction and is continuously reducing in size from the funnel side toward the neck portion in conformity with the tapered shape of the funnel portion. A pair of vertical deflection is wound around an upper portion and a lower portion of the core. A pair of horizontal deflection coils each has horizontal portions, extending at least along the opposite sides of the funnel portion, and a front-end bridge portion, extending from the horizontal portions perpendicular thereto and positioned on the upper or bottom surface of the funnel portion in a direction perpendicular to the electron beam. The horizontal deflection coils are arranged inside the core at opposite sides thereof symmetrically with respect to a horizontal plane of passage of the electron beam. At least the horizontal deflection coils have their inner surfaces intimately contacted with the outer surface of the funnel portion.

DETAILED DESCRIPTION OF EMBODIMENTS

Figure 1:
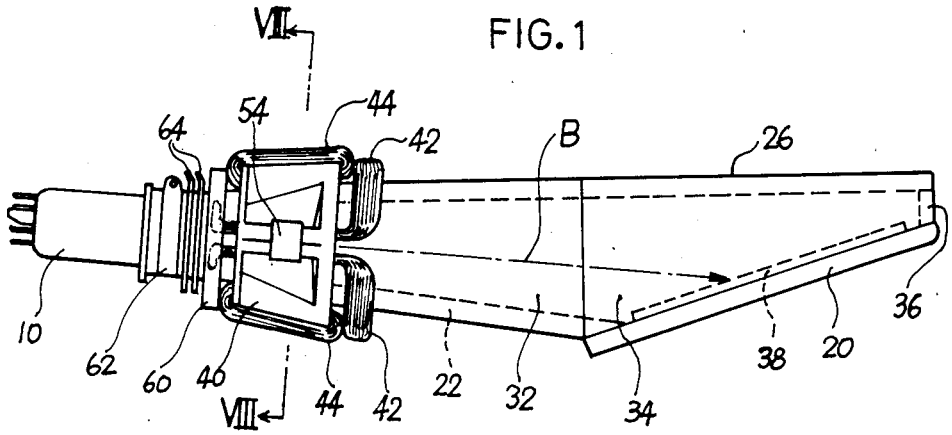
FIG. 1 is a side elevation showing a deflection yoke of the present invention as incorporated in a flat cathode-ray tube.

The present invention will be described below in detail with reference to the embodiments shown in the drawings. It is to be understood that these embodiments are given for illustrative purposes only and are in no way limitative.

An embodiment of flat glass tube will be described first which provides a cathode-ray tube incorporating a deflection yoke of the present invention. It is to be understood that flat glass tubes modified variously are also usable.

Figure 11:
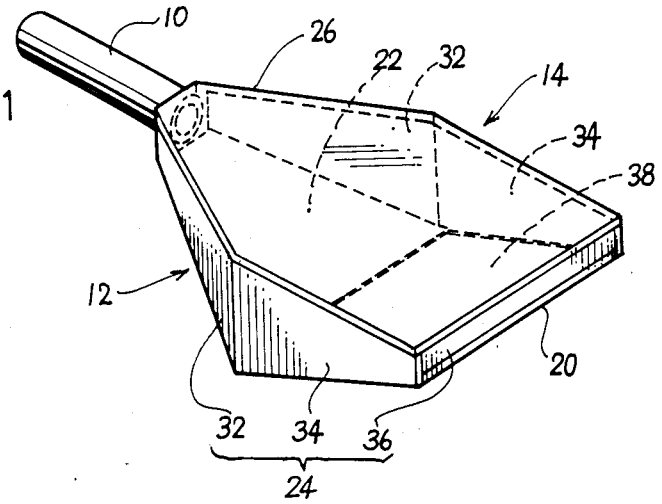
FIG. 11 is a perspective view showing an assembled flat glass tube having a funnel portion and a head portion which are made of a flat glass plate.
Figure 12:
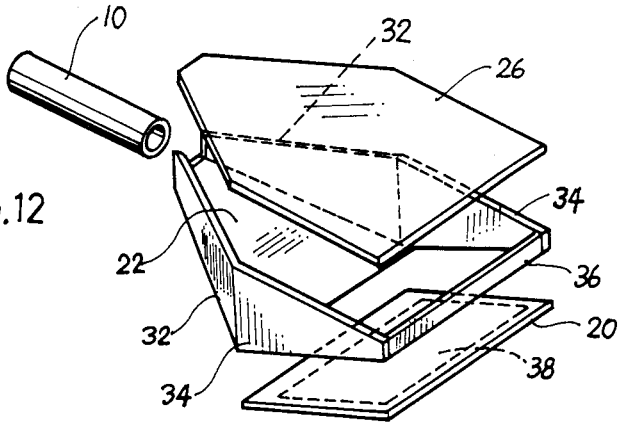
FIG. 12 is a perspective unassembled view of FIG. 11.

With reference to FIGS. 11 and 12, the flat glass tube shown comprises a neck tube 10 incorporating an electron gun, a flat funnel portion 12 and a flat box-shaped head portion 14. The assembly of the funnel portion 12 and the head portion 14 comprises a fluorescent screen panel 20 in the form of a rectangular plate, a bottom panel 22 in the form of a trapezoidal flat plate and joined to one side of the panel 20 at an obtuse angle therewith, an upstanding side panel 24 joined to the periphery of the assembly of the panels 20, 22 except at the short side of the bottom panel 22, and an opposed panel 26 in the form of a flat plate and joined to the upper end of the side panel 24. The side panel 24 comprises a pair of first lateral walls 32, 32 extending upward from the oblique sides of the bottom panel 22, a pair of second lateral walls 34, 34 extending upward from the short sides of the fluorescent screen panel 20, and a front wall 36 extending upward from the outer long side of the panel 20. The short side edge of the bottom panel 22 and the rear end edges of the first lateral walls 32 are cut obliquely to give an increased area of joint with the neck tube. The panel components are each in the form of a glass plate. The glass plate components and the neck tube are joined together into the flat glass tube shown in FIG. 11 using, for example, frit glass.

A fluorescent screen 38 is formed substantially over the entire inner surface of the screen panel 20, for example, by screen printing. When stimulated with an electron beam, the fluorescent screen 38 luminesces to reproduce thereon an image, which is observed through the transparent opposed panel 26.

The deflection yoke to be used for the cathode-ray tube must be so disposed that the center of deflection, 0, is positioned inside the funnel portion a short distance forwardly away from the neck tube as already stated. While the defection yoke comprises a core, vertical deflection coils, horizontal deflection coils, fasteners, etc. as already known, the yoke of the invention is characterized in that the core and the horizontal deflection coils have the following construction. These features only will be described.

Figure 6:
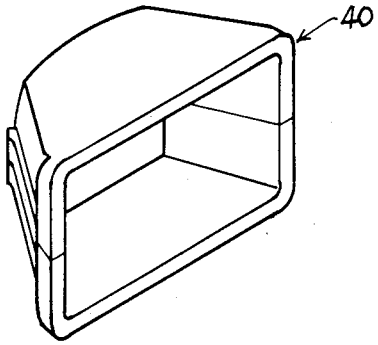
FIG. 6 is a perspective view showing another core embodying the invention.

FIG. 6 shows a core embodying the invention. The core 40 has an approximately rectangular opening at one end thereof to be positioned around the glass tube funnel portion, approximately in conformity with the cross sectional shape of the funnel portion. When mounted on the funnel portion, the core has around the funnel portion a space for accommodating the horizontal and vertical deflection coils.

Figure 2:
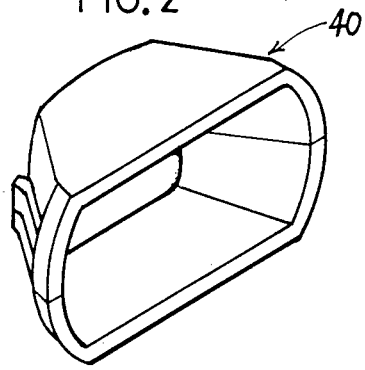
FIG. 2 is a perspective view showing a core embodying the invention.
Figure 3:
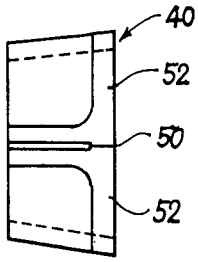
FIGS. 3 (I) and (II) are a side elevation and a front view, respectively, of the core of FIG. 2.
Figure 3:
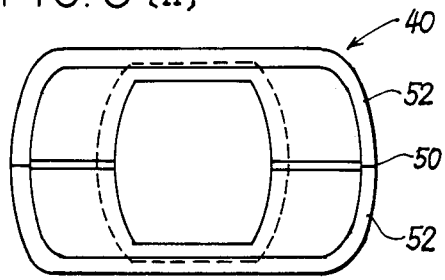
Figure 8:
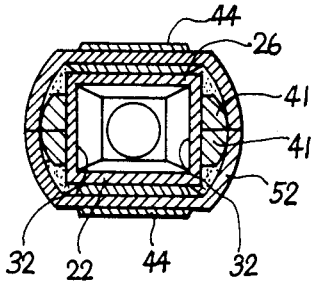
FIG. 8 is a view in section taken along the line VIII—VIII in FIG. 1.

FIGS. 2 and 3 show another core 40 embodying the invention. The core 40 has a funnel-side opening so shaped as to have parallel approximately straight upper and lower sides and arcuate opposite lateral sides gently bulging outward. The lateral side is thus shaped in conformity with the shape of horizontal portion of the horizontal deflection coil which portion bulges laterally outward as seen in FIG. 8. This embodiment is therefore more desirable than the one shown in FIG. 6 from the viewpoint of actual arrangement.

Figure 4:
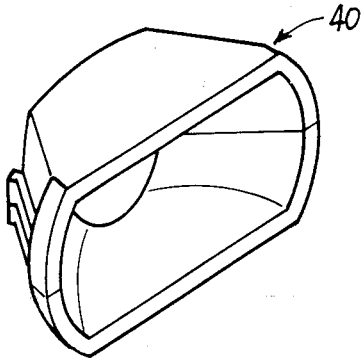
FIG. 4 is a perspective view showing another core embodying the invention.
Figure 5:
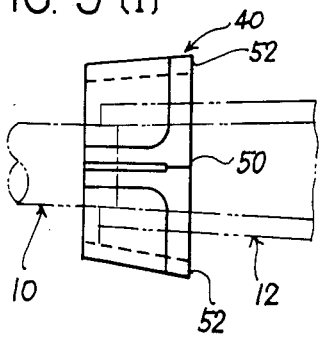
FIGS. 5 (I) and (II) are a side elevation and a front view, respectively, of the core of FIG. 4.
Figure 5:
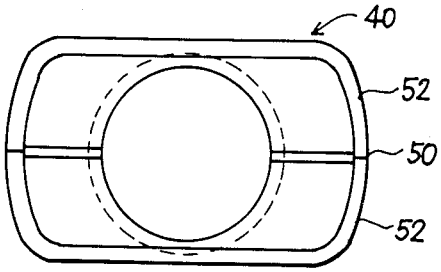

With the embodiment shown in FIGS. 2 and 3, the core 40 has an inner surface defining the opening and continuously reducing in size axially of the core from the funnel-side end toward the neck tube in conformity with the tapered shape of the funnel portion. Accordingly, the opening of the core 40 at the other end thereof around the neck tube is also so shaped as to have parallel approximately straight upper and lower sides and gently outwardly bulging lateral sides. As shown in FIG. 5 (I), the deflection yoke is disposed in the vicinity of the junction of the neck tube 10 and the funnel portion 12, so that the inner surface of the core 40 extending from the junction to the end around the neck tube is not limited in configuration to that of the embodiment of FIGS. 2 and 3. As shown in FIGS. 4 and 5, for example, the core inner surface extending approximately from the junction of the funnel portion 12 and the neck tube 10 to the neck-side end may have a circular shape in conformity with the shape of the neck tube insofar as the dimension between the upper and lower sides of the core is not great.

The core is made, for example, of sintered ferrite and comprises a pair of half segments 52, 52 which are symmetric with respect to a parting line 50. A vertical deflection coil is wound around each of the segments 52 which are separated at the parting line, and the segments are thereafter joined together with clamp means 54 (FIG. 1).

Figure 7:
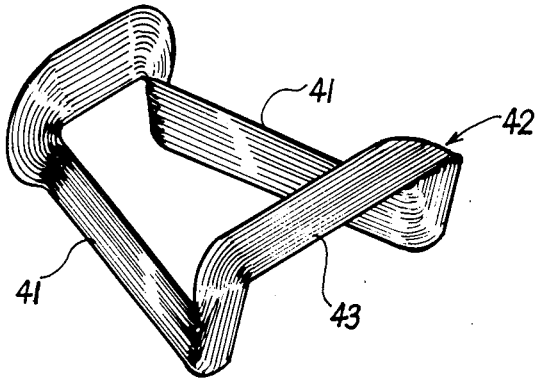
FIG. 7 is a perspective view showing a horizontal deflection coil embodying the invention.

FIG. 7 shows a horizontal deflection coil 42. A pair of horizontal deflection coils are arranged symmetrically with respect to a horizontal plane of passage of the electron beam. Each of these coils is formed in the shape of a saddle in conformity with the shape of the outer surface of the funnel portion in the vicinity of its base. The coil 42 has horizontal portions 41 shaped to extend substantially along the first lateral wall 32, and a front-end bridge portion 43 extending upward from the horizontal portions approximately perpendicular thereto and bent to extend along the the opposed or bottom panel in a direction perpendicular to the electron beam.

The assembled deflection yoke is mounted on the glass tube to form the cathode-ray tube. The deflection yoke is assembled by winding the pair of vertical deflection coils 44 around the half segments 52, 52, joining the segments together with the clamp means 54 and mounting the pair of horizontal deflection coils 42, 42 on the core 40. The ends of the upper and lower horizontal deflection coils 42 on the neck tube are made flat. A holder 60, having a tubular projecting center portion, is fitted at its base to the flat ends, followed by wiring as required. The base of the holder 60 is secured to the core with an adhesive. The holder 60 has around its tubular portion a centering magnet 64 and a fastening ring 62 for connection to the neck tube. The horizontal and vertical deflection coils are joined together with adhesive where they are in contact with each other.

Figure 9:
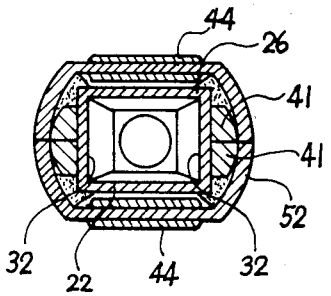
FIG. 9 is a sectional view corresponding to FIG. 8 and showing another embodiment.
Figure 10:
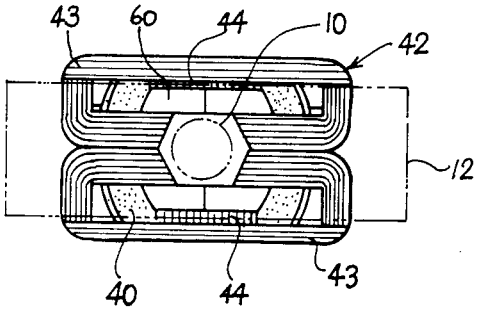
FIG. 10 is a front view showing the deflection yoke of the invention.

As seen in FIG. 9, a small clearance may be formed between the inner surface of each vertical deflection coil 44 and the outer surface of the glass tube, i.e. the outer surface of the opposed panel 26 or bottom panel 22. The yoke as mounted on the glass tube is then movable upward or downward for adjustment to position the yoke more accurately. In this case, a resin wedge is driven into the clearance toward the neck tube to fix the yoke in position.

The deflection yoke of the present invention can be so disposed as to position the center of deflection of the electron beam inside the funnel portion sufficiently inwardly thereof. This eliminates the likelihood that the electron beam will strike the inner surface of the neck tube to project a shadow on the fluorescent screen.

Figure 17:
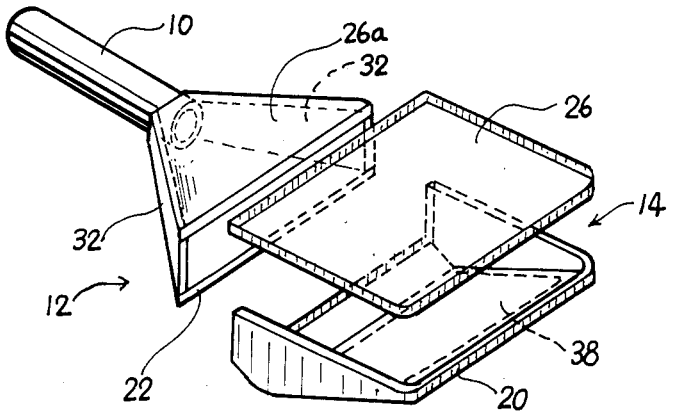
FIG. 17 is a perspective unassembled view showing another flat glass tube embodying the invention.
Figure 13:
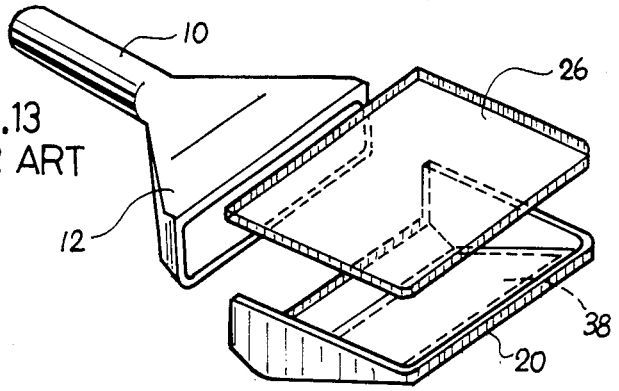
FIG.13 PRIOR ART
FIG. 13 is a perspective unassembled view showing a conventional flat glass tube.
Figure 14:
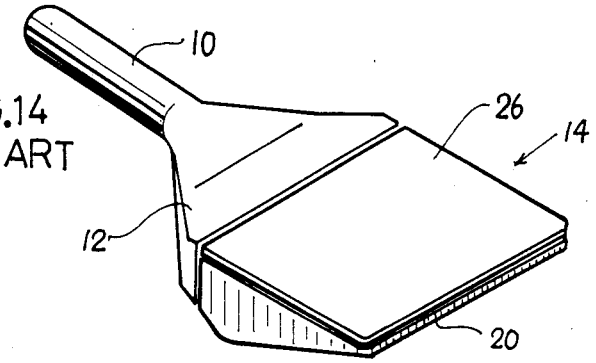
FIG.14 PRIOR ART
FIG. 14 is a perspective view showing the flat glass tube of FIG. 13 as assembled.
Figure 15:
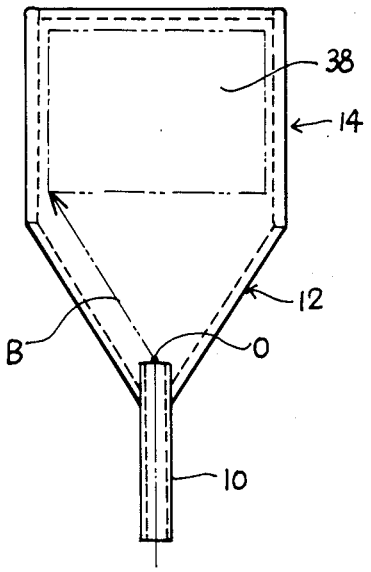
FIG. 15 is a diagram illustrating the position of deflection center of the electron beam in a cathode-ray tube comprising the glass tube of FIG. 11.
Figure 16:
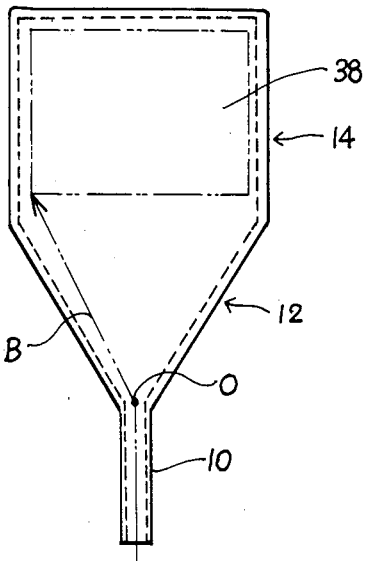
FIG.16 PRIOR ART
FIG. 16 is a diagram illustrating the position of deflection center of the electron beam in a cathode-ray tube comprising the glass tube of FIG. 14.

The deflection yoke of the present invention is useful for cathode-ray tubes of the type wherein the neck tube is joined to the funnel portion with its one end slightly projecting thereinto toward the head portion. FIG. 17 shows a cathode-ray tube wherein the funnel portion comprises a bottom panel 22, first lateral walls 32, 32 and an upper panel **26*a* which are all made of a flat plate although the tube has a fluorescent screen panel 20** which is made by press molding. Because of the above feature, the deflection yoke is usable also for this tube.

Since the inner surface of each horizontal deflection coil is so shaped as to intimately fit to the outer surface of the flat glass tube base portion, the coil is restrained from forward displacement toward the head portion by the coil horizontal portions and the bridge portion, with the result that the yoke can be mounted in place easily with the center of deflection of the electron beam positioned correctly.

Further because there is no undesirable clearance between the front-end coil bridge portion and the glass tube and also because the core is so shaped as already described, the thickness of the overall cathode-ray tube can be minimized.

The horizontal deflection coils, which have their inner surfaces intimately contacted with the glass tube, assure satisfactory horizontal deflection sensitivities.

The vertical deflection coils, which have their inner surfaces intimately contacted with the glass tube or provided with only a small clearance at the glass tube, also assure satisfactory vertical deflection sensitivities.

The tube of the invention is not limited by the foregoing description but can be modified variously without departing from the scope defined in the appended claims.

What is claimed is:

1. A flat cathode-ray tube having a tubular glass body comprising:

a tubular neck portion;

a flat funnel portion;

a flat box-shaped head portion;

an electron gun housed in the tubular neck portion; and a fluorescent screen provided at the head portion, the flat funnel portion comprising a flat trapedzoidal bottom panel, first lateral walls extending upward from oblique sides of the bottom panel, and a flat upper panel joined to an upper end of the first lateral walls, the tubular neck portion being joined to the flat funnel portion with a first end slightly projecting into the flat funnel portion toward the head portion, a center of deflection of an electron beam to be emitted by the electron gun being positioned inside the flat funnel portion slightly forwardly of the tubular neck portion, the cathode-ray tube having a deflection yoke mounted on a junction of the tubular neck portion and the flat funnel portion, the deflection yoke comprising, a core having a first open end positioned around the flat funnel portion, the core having an opening approximately rectangular in form having substantially straight upper and lower sides and gently outwardly bulging arcuate opposite lateral sides, the core having an inner surface defining the opening and continuously reducing in size from the first open end toward the tubular neck portion in conformity with a tapered shape of the flat funnel portion, the inner surface extending at least from the first open end to the junction approximately in a rectangular form having substantially straight upper and lower sides and gently outwardly bulging arcuate opposite lateral sides, a pair of vertical deflection coils wound around an upper portion and a lower portion of the core, and a pair of horizontal deflection coils arranged inside the core at opposite sides thereof symmetrically with respect to a horizontal plane of passage of the electron beam, each of the horizontal deflection coils having horizontal portions extending along an outer surface of the first lateral walls and a front-end bridge portion extending from the horizontal portions substantially perpendicular thereto and bent to extend along the flat upper panel or the bottom panel in a direction perpendicular to the electron beam, at least the horizontal deflection coil having an inner surface intimately contacted with an outer surface of the funnel portion.

2. A flat cathode-ray tube as defined in claim 1 wherein the inner surface of the core defines at a second end thereof around the neck portion an opening approximately rectangular in form having substantially straight upper and lower sides and gently outwardly bulging arcuate opposite lateral sides in conformity with the shape of the funnel portion.

3. A flat cathode-ray tube as defined in claim 1 wherein the core has a circular opening at a second end thereof around the neck portion.

4. A flat cathode-ray tube as defined in claim 1 wherein a small clearance is formed between inner surfaces of the vertical deflection coils and the outer surface of the funnel portion.

5. A flat cathode-ray tube as defined in claim 1 wherein the vertical deflection coils have inner surface intimately contacted with the outer surfaces of the funnel portion.

* * * * *

UNITED STATES PATENT AND TRADEMARK OFFICE

CERTIFICATE OF CORRECTION

PATENT NO. : 4,754,190

DATED : June 28, 1988

INVENTOR(S) : Katsuhiro HINOTANI et al

It is certified that error appears in the above-identified patent and that said Letters Patent is hereby corrected as shown below:

On the cover page, to the left of Item [45], "Hinotami et al" should read --Hinotani et al--;

Item [75], "Katsuhiro Hinotami" should read --Katsuhiro Hinotani--.

Signed and Sealed this

Tenth Day of January, 1989

*Attest:*

*Attesting Officer*

DONALD J. QUIGG

*Commissioner of Patents and Trademarks*